United States Patent [19]

Kawaguchi et al.

[11] Patent Number: 4,704,076

[45] Date of Patent: Nov. 3, 1987

[54] ROTARY COMPRESSOR

[75] Inventors: Susumu Kawaguchi, Fujieda; Takuho Hirahara, Shizuoka; Kazuhiro Nakane, Shizuoka; Sei Ueda, Shimizu, all of Japan

[73] Assignee: Mitsubishi Denki Kabushiki Kaisha, Tokyo, Japan

[21] Appl. No.: 781,989

[22] Filed: Sep. 30, 1985

[30] Foreign Application Priority Data

Oct. 11, 1984 [JP] Japan ..... 59-213131

[51] Int. Cl.[4] ..... F04C 29/02

[52] U.S. Cl. ..... 418/91; 184/6.16

[58] Field of Search ..... 418/91–94, 418/75, 77, 79, 63, 76; 184/6.16

[56] References Cited

U.S. PATENT DOCUMENTS 2,669,384 2/1954 Dills ..... 418/63
2,883,101 4/1959 Kosfeld ..... 418/94
2,991,931 7/1961 Galin ..... 418/91
3,082,937 3/1963 Tucker ..... 418/94

FOREIGN PATENT DOCUMENTS 222013 9/1924 United Kingdom ..... 418/94

OTHER PUBLICATIONS

Proceedings of the 1982 Purdue Compressor Technology Conference.

*Primary Examiner*—Carlton R. Croyle
*Assistant Examiner*—Jane E. Obee
*Attorney, Agent, or Firm*—Oblon, Fisher, Spivak, McClelland, & Maier

[57] ABSTRACT

An oil hole is formed in a thrust-bearing surface in the eccentric part of a rotary shaft so that a given amount of lubricating oil is always maintained in the oil hole, whereby shortage of oil does not occur at the time of restarting of the rotary compressor after a long term pause of the operation.

1 Claim, 4 Drawing Figures

ROTARY COMPRESSOR

BACKGROUND OF THE INVENTION

1. Field of the Invention

The present invention relates to a rotary compressor having a lubricating oil supplying device. More particularly, it relates to an improvement in feeding of oil to a thrust-bearing surface which is in slide-contact with an eccentric part of a rotary shaft.

2. Description of Prior Art

FIG. 1 is a cross-sectional view of an important part of a conventional rotary compressor as disclosed in Japanese Unexamined Patent Publication No. 106089/1981.

In FIG. 1, a reference numeral 1 designates a cylinder and a numeral 2 designates a rotary shaft which is adapted to be rotated in the cylinder and having an eccentric part 3 formed integrally with it. The rotary shaft is driven by a motor (not shown) provided at the upper side on the drawing. A rolling piston 4 is fitted on the outer circumferential surface of the eccentric part 3 to eccentrically rotate in the cylinder 1 in accordance with the rotation of the rotary shaft. A reference numeral 5 designates a main bearing plate for supporting a part of the rotary shaft 2 extending toward the motor and a numeral 6 designates a sub-bearing plate for supporting a part of the rotary shaft 2 extending in the direction opposite the motor with respect to the eccentric part 3, both the bearing plates being placed at both sides of the cylinder 1 to keep the inside of the cylinder in a hermetic condition. A numeral 7 designates vanes whose extreme ends are usually in contact with the rolling piston 4 under a desired pressure applied by means of compression springs, a numeral 8 designates a thrust-bearing surface formed between the eccentric part 3 and the sub-bearing plate 6, a symbol A designates a conduit formed in the axial center portion of the rotary shaft 2 to feed lubricating oil for circulation in the compressor device, a symbol a indicates oil feeding passages formed in the rotary shaft 2 in the radial direction from the conduit, and a symbol B indicates a compression chamber.

In the conventional rotary compressor having the construction as above-mentioned, there is a disadvantage such that since there is no facility to keep the lubricating oil in the thrust-bearing surface, when the compressor is to be re-started after the operation of the compressor has been paused for a long term, there arises a shortage of oil in the thrust-bearing surface 8, with the result that friction in the thrust-bearing surface frequently occurs, whereby much input power is required at the time of restarting of the compressor.

SUMMARY OF THE INVENTION

It is an object of the present invention to eliminate the disadvantage of the conventional rotary compressor and to provide an improved rotary compressor free from shortage of lubricating oil at restarting time after a long term pause of operation.

The foregoing and the other objects of the present invention have been attained by providing a rotary compressor which comprises a cylinder, a rotary shaft having an eccentric part, and a pair of bearing plates which close hermetically both open ends formed in the cylinder and rotatably support the rotary shaft, the rotary compressor including a lubricating oil supplying device in which an oil hole is formed in at least one end surface of the eccentric part being in slide-contact with the bearing plates so as to store lubricating oil circulating inside the rotary compressor.

DETAILED DESCRIPTION OF PREFFERED EMBODIMENTS

Figure 1:
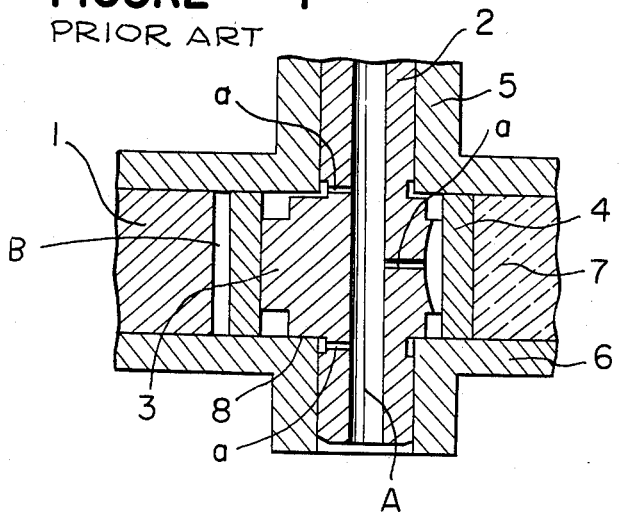
FIGURE 1 PRIOR ART
FIG. 1 is a cross-sectional view of an important part of a conventional rotary compressor.
Figure 2:
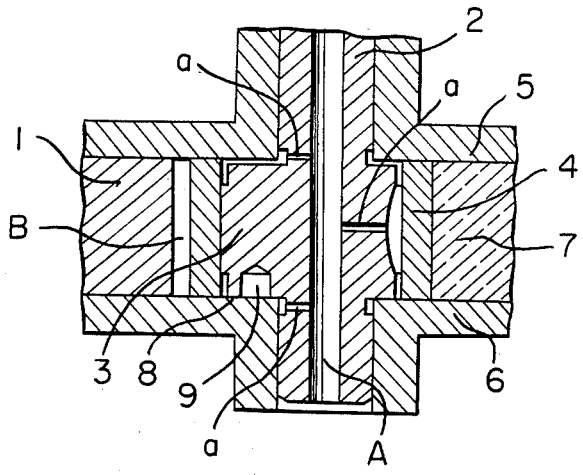
FIG. 2 is a cross-sectional view of an important part of a first embodiment of the rotary compressor according to the present invention.
Figure 3:
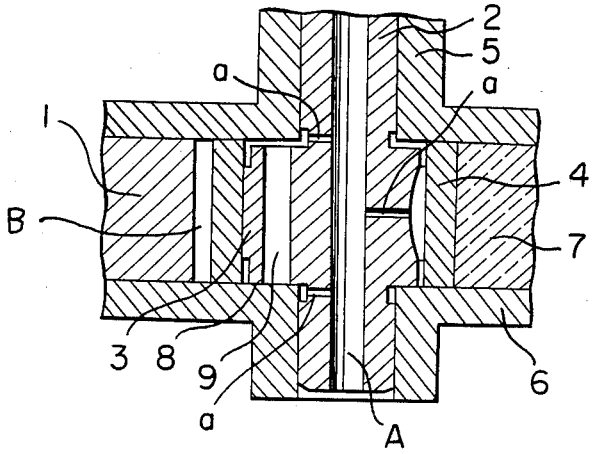
FIG. 3 is a cross-sectional view of a second embodiment of the present invention.
Figure 4:
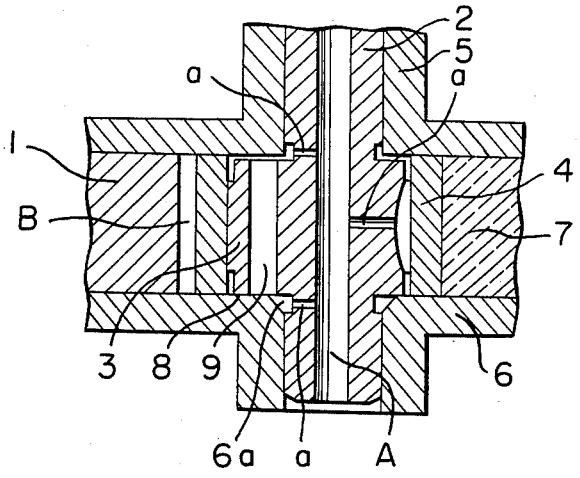
FIG. 4 is a cross-sectional view of a third embodiment of the present invention

FIGS. 2 to 4 show the first to the third embodiments of the present invention in which the same reference numerals as in FIG. 1 designate the same or corresponding parts and therefore, description of these parts is omitted.

In the first embodiment of the present invention shown in FIG. 2, isolated oil hole 9 is formed in the eccentric part 3 so as to open in the thrust-bearing surface 8 formed between the eccentric part 3 and the sub-bearing plate 6 placed opposing the motor with respect to the eccentric part 3. The oil hole 9 can maintain a predetermined amount of lubricating oil. Accordingly, shortage of oil in the thrust-bearing surface 8 which may occur at the restarting of the rotary compressor can be eliminated.

Generally, the rotary compressor of the present invention is used under the condition that the rotary shaft 2 extends in the vertical direction. In this case, the main bearing plate 5 functions as an upper bearing plate to rotatably support the upper part of the rotary shaft 2, and the sub-bearing plate 6 functions as a lower bearing plate.

Since the oil hole 9 is formed in the eccentric part 3 to open the thrust-bearing surface 8 in a form of recess, the lubricating oil suppled to the thrust-bearing surface 8 during the operation of the rotary compressor is stored in the recessed oil hole 9, thus supply of oil to the oil hole 9 is carried out.

In the second embodiment of the present invention shown in FIG. 3, the oil hole 9 is a through hole extending and opening in the both thrust-bearing surfaces formed between the main bearing plate 5 and the eccentric part 3 and the sub-bearing plate 6 and the eccentric part 3. With the construction of the second embodiment, the capacity of holding the lubricating oil can be further increased in comparison with the first embodiment and therefore, it is flexible to change in condition of the thrust-bearing surface. The second embodiment is particularly effective in the case the thrust-bearing surface is also formed between the main bearing plate 5 and the eccentric part 3.

FIG. 4 shows the third embodiment of the present invention. The oil hole is formed extending both end surfaces of the eccentric part 3, and a chamfered part *6a* is formed in the sub-bearing plate so that the oil hole 9 is communicated with one of oil feeding passages a formed in the radial direction in the rotary shaft 2. Accordingly, the lubricating oil stored in the oil hole 9 is well circulated to control temperature rise in the lubricating oil, whereby reduction in lubricating characteristic of the oil due to temperature rise is avoidable.

In the third embodiment, when the compressor is stopped, the lubricating oil flows out the oil hole 9. However, immediately after restarting of the operation of the compressor, oil supply is initiated to the thrust-bearing surface 8 from the conduit A through the two oil feeding passages a, a, the chamfered part *6a* and the oil hole 9. Accordingly, shortage of oil will not take place.

In the foregoing, description has been made as to formation of the thrust-bearing surface between the eccentric part and the sub-bearing plate. However, it is feasible that the thrust-bearing surface is formed between the main bearing plate and the eccentric part.

Thus, an oil hole for lubricating oil is formed in a thrust-bearing surface with respect to an eccentric part formed in a rotary shaft, shortage of oil in the thrust-bearing surface which may occur at the restarting time of the rotary compressor after a pause of operation can be avoided. This remarkably increase reliability in the thrust-bearing part. Further, the oil hole is communicated with an oil feeding passage formed in the rotary shaft in the radial direction, whereby ability of feeding the lubricating oil to the oil hole during normal operation of the rotary compressor is increased. The increased ability of oil feeding supresses temperature rise in the lubricating oil to be circulated in the rotary compressor, and reduction in lubricating characteristic due to temperature rise can be certainly prevented.

What is claimed is:

1. A rotary compressor comprising:

means defining a cylinder and bearing plates closing opposite ends of said cylinder;

a rotary shaft extending through said cylinder along a vertical axis parallel to the axis of said cylinder;

an eccentric part in said cylinder and fixed to said shaft, at least a bottom end surface of said eccentric part being in slide bearing contact with one of said bearing plates; and lubricating oil supplying means comprising:

(a) an oil hole extending in said eccentric part from said bottom axial end face of said eccentric part to a top axial end face of said eccentric part, (b) an axially extending oil feeding conduit in said shaft, (c) radially extending oil feeding passage means connecting said oil feeding conduit to said bearing plates for lubricating said bearing plates, (d) first means for communicating said oil hole with said passage means connecting said oil feeding conduit with another of said bearing plates in bearing contact with said top axial end face of said eccentric part, and (e) second means for communicating said oil hole with said passage means connecting said oil feeding conduit with said one of said bearing plates, whereby oil circulation through said hole is improved, wherein said second means for communicating comprises a chamfer formed in said one bearing plate.

* * * * *